US010619631B2

(12) United States Patent
Chen et al.

(10) Patent No.: US 10,619,631 B2
(45) Date of Patent: Apr. 14, 2020

(54) MINIATURE PNEUMATIC DEVICE

(71) Applicant: Microjet Technology Co., Ltd., Hsinchu (TW)

(72) Inventors: Shih-Chang Chen, Hsinchu (TW); Jia-Yu Liao, Hsinchu (TW); Jheng-Wei Chen, Hsinchu (TW); Yung-Lung Han, Hsinchu (TW); Chi-Feng Huang, Hsinchu (TW); Chang-Yen Tsai, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 284 days.

(21) Appl. No.: 15/861,831

(22) Filed: Jan. 4, 2018

(65) Prior Publication Data

US 2018/0187670 A1 Jul. 5, 2018

(30) Foreign Application Priority Data

Jan. 5, 2017 (TW) ..... 106100265 A

(51) Int. Cl.
*F04B 43/04* (2006.01)
*F04B 45/047* (2006.01)

(52) U.S. Cl.
CPC ..... *F04B 43/046* (2013.01); *F04B 43/043* (2013.01); *F04B 45/047* (2013.01)

(58) Field of Classification Search
CPC .... F04B 43/043; F04B 43/046; F04B 19/006; B01L 2200/027
See application file for complete search history.

(56) References Cited

U.S. PATENT DOCUMENTS 4,344,743 A * 8/1982 Bessman ..... F04B 49/06 310/324
4,939,405 A * 7/1990 Okuyama ..... F04B 43/046 310/317
5,259,737 A * 11/1993 Kamisuki ..... B81B 3/0005 257/E21.233

(Continued)

FOREIGN PATENT DOCUMENTS

CN 101328879 A 12/2008
CN 103334907 A 10/2013

(Continued)

*Primary Examiner* — Patrick Hamo
(74) *Attorney, Agent, or Firm* — Birch, Stewart, Kolasch & Birch, LLP

(57) ABSTRACT

A miniature pneumatic device includes a miniature fluid control device and a miniature valve device. The miniature fluid control device includes a gas inlet plate, a resonance plate, a piezoelectric actuator and a gas collecting plate. A first chamber is formed between the resonance plate and the piezoelectric actuator. The miniature valve device includes a valve film and a gas outlet plate. The valve film and the gas outlet plate are stacked on the gas collecting plate. An area of the gas outlet plate is smaller than an area of the gas collecting plate. An adhesive-coating space is defined between four edges of the gas outlet plate and the gas collecting plate. A sealing adhesive is filled in the adhesive-coating space to completely seal a periphery region of the valve film. The first surface and the second surface of the valve film comprise sticking areas.

10 Claims, 12 Drawing Sheets

(56) References Cited

U.S. PATENT DOCUMENTS

| | | | | | |
|---|---|---|---|---|---|
| 5,611,676 | A * | 3/1997 | Ooumi | F04B 43/046 | 417/322 |
| 5,759,014 | A * | 6/1998 | Van Lintel | F04B 43/043 | 417/413.2 |
| 5,759,015 | A * | 6/1998 | Van Lintel | F04B 43/043 | 417/322 |
| 5,816,780 | A * | 10/1998 | Bishop | F04B 17/003 | 417/322 |
| 6,261,066 | B1 * | 7/2001 | Linnemann | F04B 43/043 | 417/413.1 |
| 6,368,079 | B2 * | 4/2002 | Peters | F04B 43/046 | 417/413.2 |
| 6,481,984 | B1 * | 11/2002 | Shinohara | F04B 43/046 | 417/413.2 |
| 6,827,559 | B2 * | 12/2004 | Peters | F04B 43/046 | 417/248 |
| 7,841,843 | B2 * | 11/2010 | Cho | F04F 7/00 | 417/413.1 |
| 7,942,650 | B2 * | 5/2011 | Kitahara | F04B 43/046 | 138/30 |
| 8,490,926 | B2 * | 7/2013 | Clingman | B64C 21/04 | 244/207 |
| 2015/0114222 | A1 | 4/2015 | Murakami | | |

FOREIGN PATENT DOCUMENTS

| | | | |
|---|---|---|---|
| CN | 203488347 | U | 3/2014 |
| CN | 104153978 | A | 11/2014 |
| CN | 104246228 | A | 12/2014 |
| TW | M528306 | U | 9/2016 |
| WO | 2013/168551 | A1 | 11/2013 |

* cited by examiner

MINIATURE PNEUMATIC DEVICE

FIELD OF THE INVENTION

The present invention relates to a miniature pneumatic device, and more particularly to a slim and silent miniature pneumatic device.

BACKGROUND OF THE INVENTION

With the advancement of science and technology, fluid transportation devices used in many sectors such as pharmaceutical industries, computer techniques, printing industries or energy industries are developed toward elaboration and miniaturization. The fluid transportation devices are important components that are used in for example micro pumps, micro atomizers, printheads or industrial printers. Therefore, it is important to provide an improved structure of the fluid transportation device.

For example, in the pharmaceutical industries, pneumatic devices or pneumatic machines use motors or pressure valves to transfer gases. However, due to the volume limitations of the motors and the pressure valves, the pneumatic devices or the pneumatic machines are bulky in volume. In other words, the conventional pneumatic device fails to meet the miniaturization requirement, and is not suit to be installed in or cooperated with a portable equipment. Moreover, during operations of the motor or the pressure valve, annoying noise is readily generated.

FIG. 8 is a schematic cross-sectional view illustrating a conventional miniature pneumatic device. As shown in FIG. 8, the miniature pneumatic device 2 comprises a miniature fluid control device 2A and a miniature valve device 2B. In this embodiment, the miniature fluid control device 2A comprises a housing 2*a*, a piezoelectric actuator 23, a first insulation plate 241, a conducting plate 25 and a second insulation plate 242. The housing 2*a* comprises a gas collecting plate 26 and a base 20. The base 20 comprises a gas inlet plate 21 and a resonance plate 22. The piezoelectric actuator 23 is aligned with the resonance plate 22. The gas inlet plate 21, the resonance plate 22, the piezoelectric actuator 23, the first insulation plate 241, the conducting plate 25, the second insulation plate 242 and the gas collecting plate 26 are stacked on each other sequentially. The miniature valve device 2B comprises a valve film 27 and a gas outlet plate 28. The valve film 27 and the gas outlet plate 28 of the miniature valve device 2B are stacked on each other and positioned on the gas collecting plate 26 of the miniature fluid control device 2A. Moreover, a sealing adhesive 29 is coated on the periphery region of the valve film 27 to prevent from leakage. Consequently, a simple slim-type miniature pneumatic device 2 is assembled.

The miniature pneumatic device is applicable to equipment or machine and has small, miniature, silent, portable and comfortable benefits. However, since the sealing adhesive 29 is coated on the periphery region of the valve film 27 to prevent from leakage and the valve film 27 is adhered between the gas outlet plate 28 and the gas collecting plate 26, some drawbacks occur. For example, the long-term vibration may destroy the airtight condition of the sealing adhesive. Because of the insufficient airtight condition, the working characteristics and flowrate of the miniature pneumatic device 2 is adversely affected. Moreover, since the space between the gas outlet plate 28 and the gas collecting plate 26 is very small, it is difficult to coat the sealing adhesive 29.

Therefore, there is a need of providing a miniature pneumatic device in order to eliminate the above drawbacks.

SUMMARY OF THE INVENTION

The present invention provides a miniature pneumatic device for use with a portable or wearable equipment or machine. The area of a gas outlet plate of the miniature valve device is smaller than the area of a gas collecting plate of the miniature fluid control device. Consequently, an adhesive-coating space is defined between the periphery region of the gas outlet plate and the gas collecting plate. Due to the increase of the adhesive-coating space, the sealing efficacy is increased. Moreover, double-sided adhesives are attached on the first surface and the second surface of a valve film, the valve film can be securely attached in the space between the miniature fluid control device and the miniature valve device. Consequently, the airtight efficacy is enhanced.

In accordance with an aspect of the present invention, a miniature pneumatic device is provided. The miniature pneumatic device includes a miniature fluid control device and a miniature valve device. The miniature fluid control device includes a gas inlet plate, a resonance plate, a piezoelectric actuator and a gas collecting plate. The resonance plate has a central aperture. The gas collecting plate includes a concave plane, a datum plane, a first perforation and a second perforation. The concave plane is concaved to form a gas-collecting chamber. The datum plane is concaved to form a first pressure-releasing chamber and a first outlet chamber. The first pressure-releasing chamber is in communication with the gas-collecting chamber through the first perforation. The first outlet chamber is in communication with the gas-collecting chamber through the second perforation. The gas inlet plate, the resonance plate, the piezoelectric actuator and the gas collecting plate are stacked on each other sequentially. A gap is formed between the resonance plate and the piezoelectric actuator to define a first chamber. When the piezoelectric actuator is actuated, the gas is fed into the miniature fluid control device through the gas inlet plate, transferred through the resonance plate, and introduced into the first chamber. The miniature valve device is positioned on the gas collecting plate of the miniature fluid control device. The miniature valve device includes a valve film and a gas outlet plate. The valve film includes a first surface, a second surface and a valve opening. The valve opening penetrates through the first surface and the second surface of the valve film. Each of the first surface and the second surface of the valve film includes a sticking area and a plurality of non-sticking area. The gas outlet plate includes a datum plane and a second surface. A pressure-releasing perforation and an outlet perforation are respectively formed on the second surface of the gas outlet plate and penetrate through the datum plane of the gas outlet plate. The datum plane of the gas outlet plate is concaved to form a second pressure-releasing chamber and a second outlet chamber. The pressure-releasing perforation is located at a center of the second pressure-releasing chamber. The outlet perforation is in communication with the second outlet chamber. The gas outlet plate further comprises a communication channel between the second pressure-releasing chamber and the second outlet chamber. The valve film and the gas outlet plate are sequentially stacked on the gas collecting plate. An area of the gas outlet plate is smaller than an area of the gas collecting plate in order to shrink four edges of the gas outlet plate to maintain an adhesive-coating space formed between four edges of the gas outlet plate and the gas collecting plate. A sealing adhesive is filled in the adhesive-coating space to completely seal a periphery region of the valve film. The valve film is positioned between the gas outlet plate and the gas collecting plate through the sticking areas of the first surface and the second surface. A gas is transferred from the miniature fluid control device to the miniature valve device, so that a pressure-collecting operation or a pressure-releasing operation is selectively performed.

The above contents of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
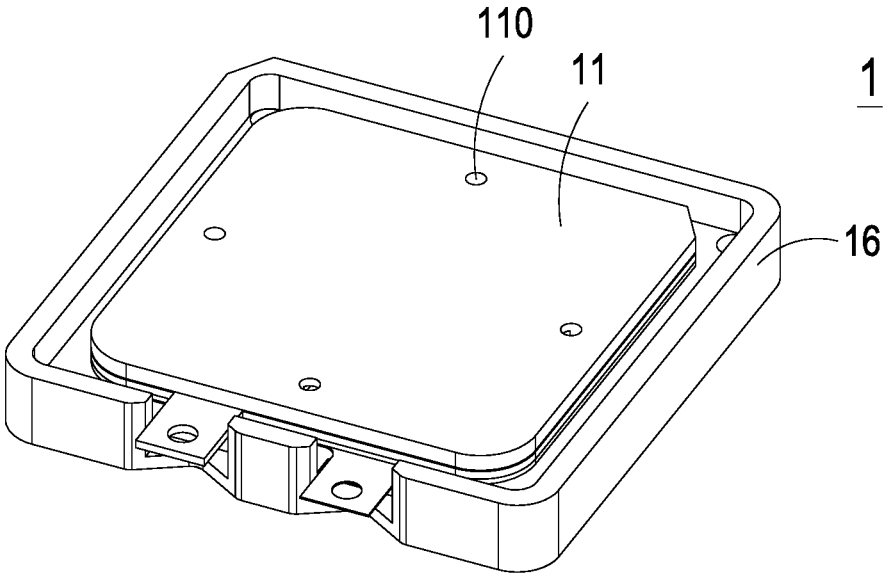
FIG. 1A is a schematic perspective view of a miniature pneumatic device according to an embodiment of the present invention and taken along the front side.
Figure 1B:
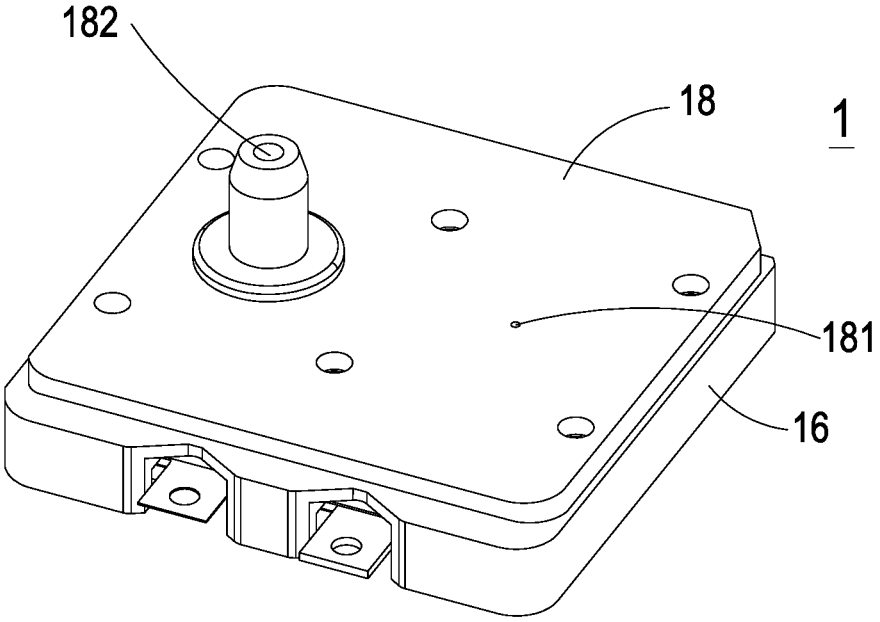
FIG. 1B is a schematic perspective view illustrating the miniature pneumatic device according to the embodiment of the present invention and taken along the rear side.
Figure 1C:
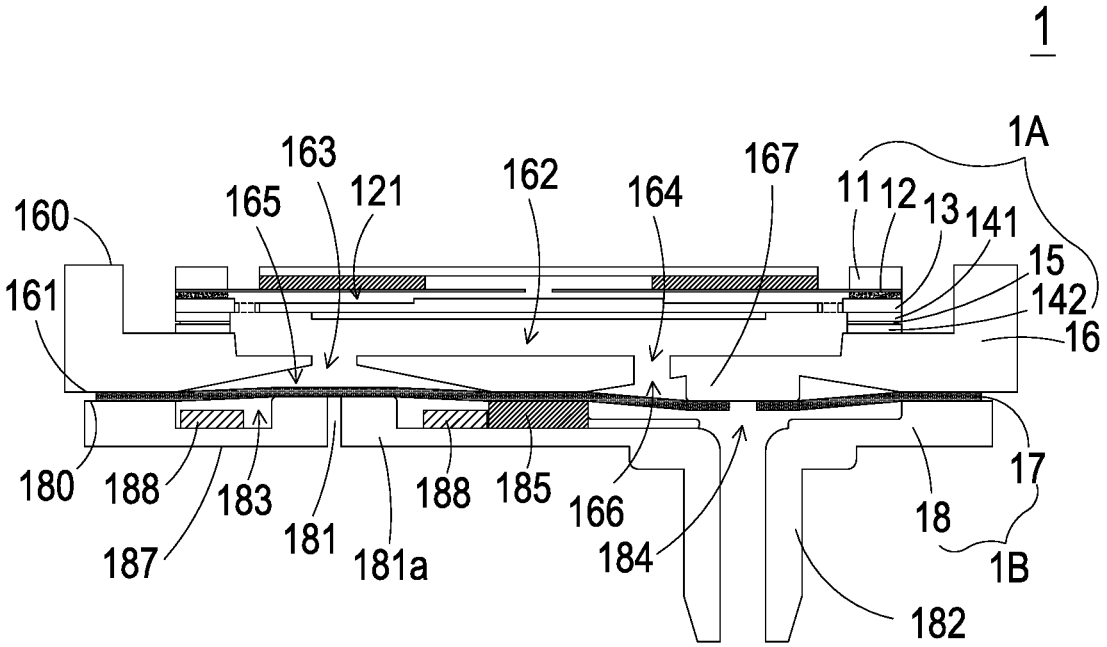
FIG. 1C is a schematic cross-sectional view of the miniature pneumatic device according to the embodiment of the present invention.
Figure 1D:
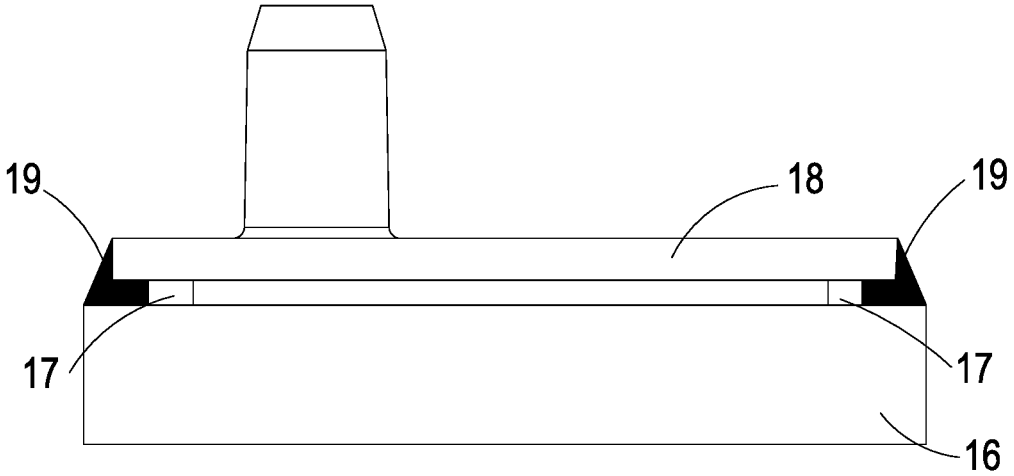
FIG. 1D is a schematic side view of the miniature pneumatic device according to the embodiment of the present invention.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a miniature pneumatic device. The miniature pneumatic device may be used in many sectors such as pharmaceutical industries, energy industries, computer techniques or printing industries for transporting gases, but the invention is not limited thereto. Please refer to FIGS. 1A, 1B, 1C, 1D, 2A and 2B. As shown in the drawings, the miniature pneumatic device 1 comprises a miniature fluid control device 1A and a miniature valve device 1B. In this embodiment, the miniature fluid control device 1A comprises a housing 1*a*, a piezoelectric actuator 13, a first insulation plate 141, a conducting plate 15 and a second insulation plate 142. The housing 1*a* comprises a gas collecting plate 16 and a base 10. The base 10 comprises a gas inlet plate 11 and a resonance plate 12, but the invention is not limited thereto. The piezoelectric actuator 13 is aligned with the resonance plate 12. The gas inlet plate 11, the resonance plate 12, the piezoelectric actuator 13, the first insulation plate 141, the conducting plate 15, the second insulation plate 142 and the gas collecting plate 16 are stacked on each other sequentially. Moreover, the piezoelectric actuator 13 comprises a suspension plate 130, an outer frame 131, at least one bracket 132 and a piezoelectric ceramic plate 133. In this embodiment, the miniature valve device 1B comprises a valve film 17, a gas outlet plate 18 and a sealing adhesive 19.

Figure 2A:
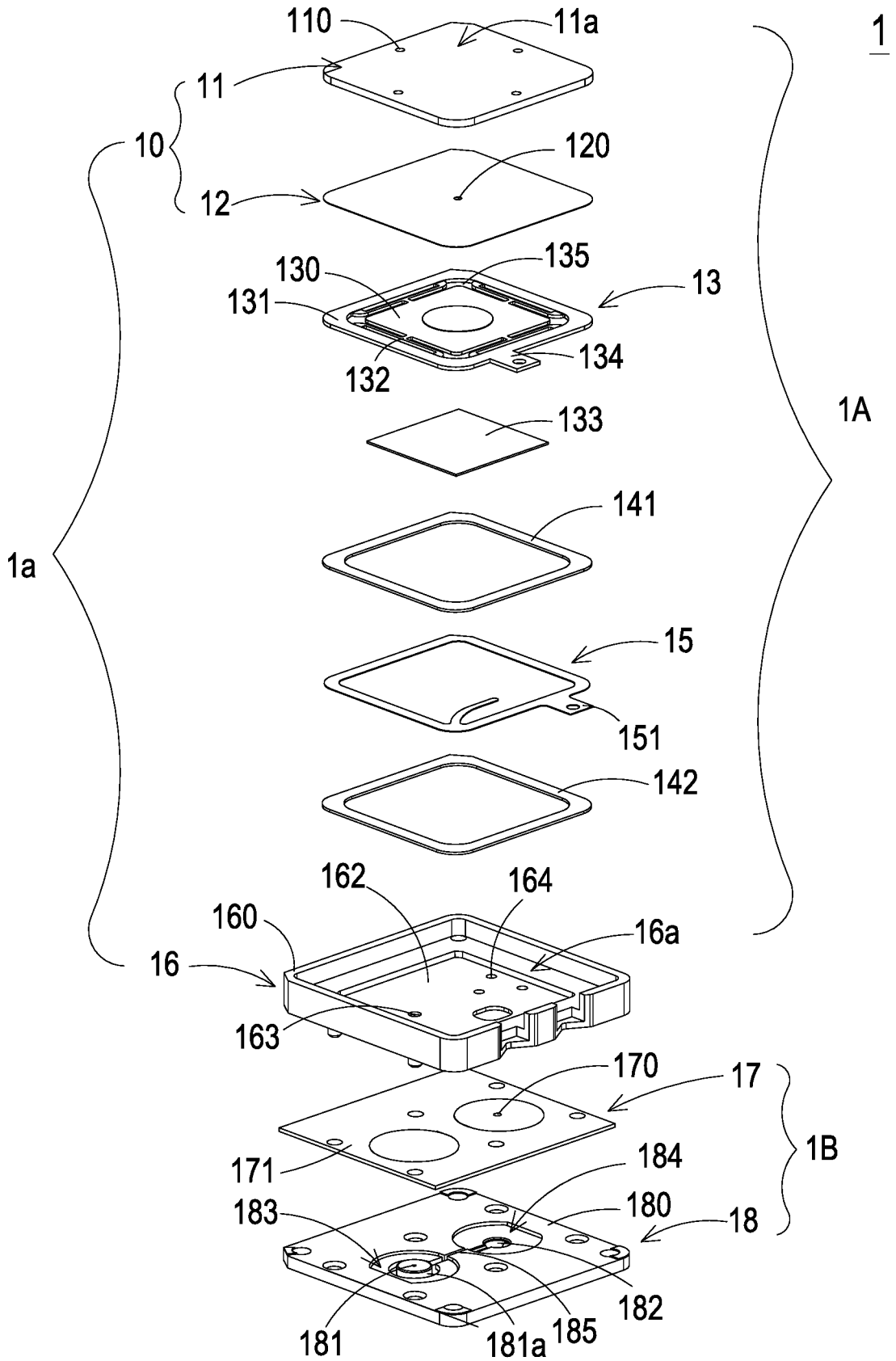
FIG. 2A is a schematic exploded view of the miniature pneumatic device according to the embodiment of the present invention and taken along the front side.
Figure 2B:
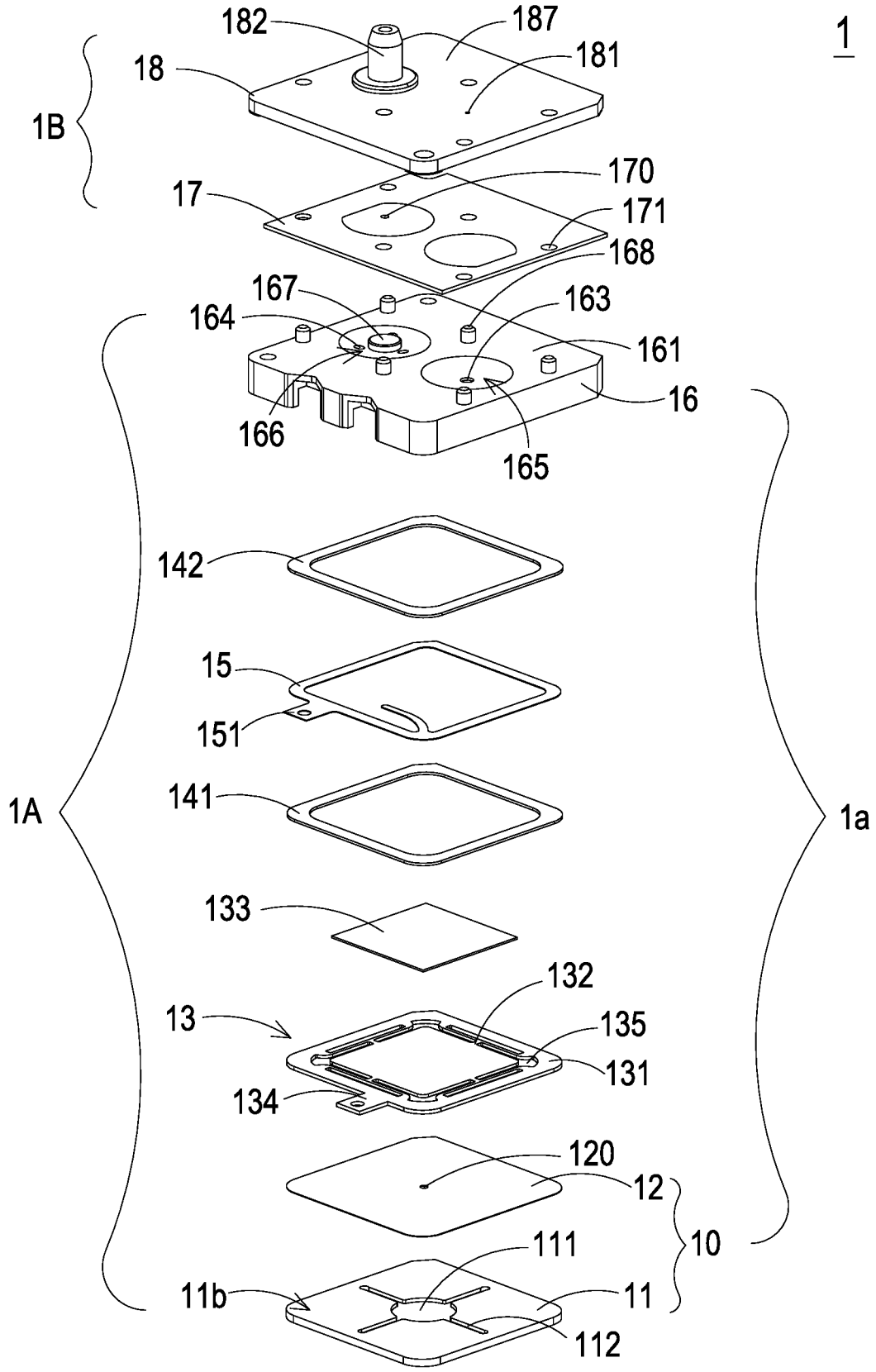
FIG. 2B is a schematic exploded view illustrating the miniature pneumatic device according to the embodiment of the present invention and taken along the rear side.

The gas inlet plate 11 of the miniature fluid control device 1A comprises a first surface 11*a*, a second surface 11*b* and the at least one inlet 110. In this embodiment, the gas inlet plate 11 has four inlets 110, but the invention is not limited thereto. The inlets 110 penetrate through the first surface 11*a* and the second surface 11*b* of the gas inlet plate 11, and the first surface 11*a* is towards exterior of the miniature pneumatic device 1 where is defined as the input side. In response to the action of the atmospheric pressure, the gas is introduced into the miniature fluid control device 1A through the inlets 110. As shown in FIG. 2A, at least one convergence channel 112 is formed on the second surface 11*b* of the gas inlet plate 11, and is in communication with the at least one inlet 110 of the first surface 11*a* of the gas inlet plate 11. Moreover, a central cavity 111 is formed on the second surface 11*b* of the gas inlet plate 11 and located at the intersection of the four convergence channels 112 that forming a convergence chamber for temporarily storing the gas. The central cavity 111 is in communication with all of the convergence channels 112, such that the gas entered by the inlets 110 would be introduced into the at least one convergence channel 112 and is guided to the central cavity 111. In this embodiment, the at least one inlet 110, the at least one convergence channel 112 and the central cavity 111 of the gas inlet plate 11 are integrally formed.

Preferably but not exclusively, the gas inlet plate 11 is made of stainless steel. Moreover, the depth of the convergence chamber defined by the central cavity 111 is equal to the depth of the at least one convergence channel 112. The resonance plate 12 is made of a flexible material, which is preferably but not exclusively copper. The resonance plate 12 further has a central aperture 120 corresponding to the central cavity 111 of the second surface 11*b* of the gas inlet plate 11 that providing the gas for flowing through.

Figure 3A:
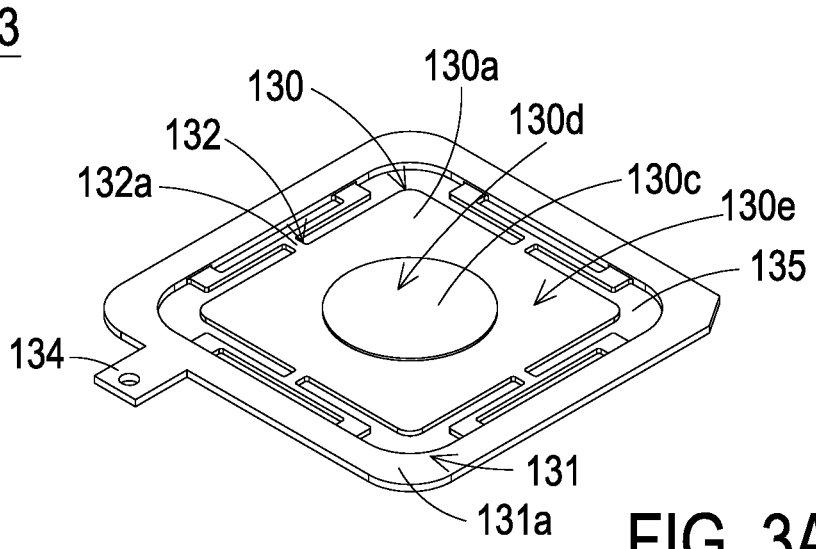
FIG. 3A is a schematic perspective view illustrating the piezoelectric actuator of the miniature pneumatic device of the present invention and taken along the front side.
Figure 3B:
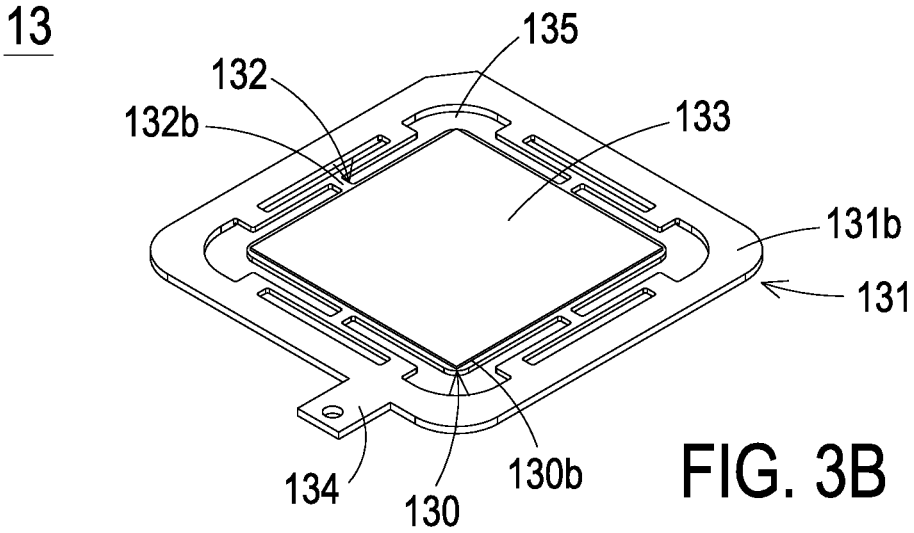
FIG. 3B is a schematic perspective view illustrating the piezoelectric actuator of the miniature pneumatic device of the present invention and taken along the rear side.
Figure 3C:
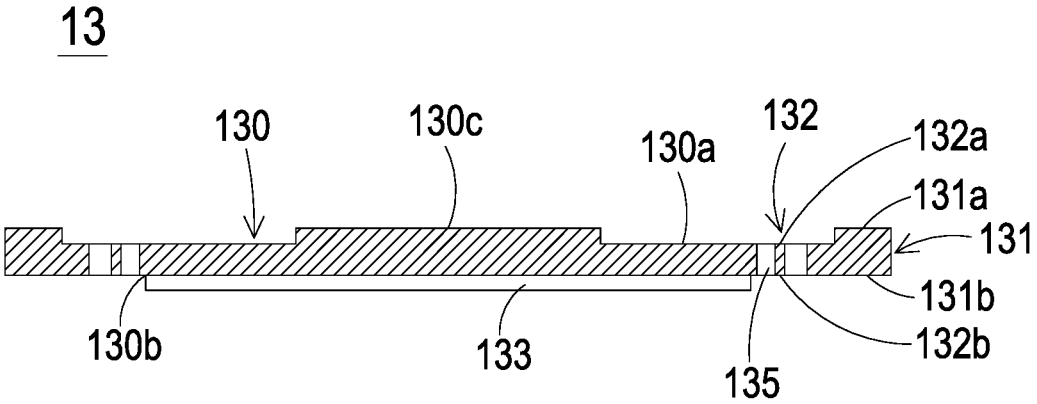
FIG. 3C is a schematic cross-sectional view illustrating the piezoelectric actuator of the miniature pneumatic device of the present invention.

As shown in FIGS. 3A, 3B and 3C, the piezoelectric actuator 13 comprises the suspension plate 130, the outer frame 131, the at least one bracket 132, and the piezoelectric ceramic plate 133. The length of a side of the piezoelectric ceramic plate 133 is equal to or less than the length of a side of the suspension plate 130. The piezoelectric ceramic plate 133 is attached on a first surface 130*b* of the suspension plate 130. In response to an applied voltage, the piezoelectric ceramic plate 133 would be subjected to a curvy vibration. The suspension plate 130 comprises a middle portion 130*d* and a periphery portion 130*e*. When the piezoelectric ceramic plate 133 is subjected to the curvy vibration, the suspension plate 130 is also subjected to the curvy vibration and vibrates from the middle portion 130*d* to the periphery portion 130*e*. The at least one bracket 132 is connected between the suspension plate 130 and the outer frame 131, while two ends of the bracket 132 are connected with the outer frame 131 and the suspension plate 130 respectively that the bracket 131 can elastically support the suspension plate 130. At least one vacant space 135 is formed between the bracket 132, the suspension plate 130 and the outer frame 131 for allowing the gas to go through. The type of the suspension plate 130 and the outer frame 131 and the type and the number of the at least one bracket 132 may be varied according to the practical requirements. Moreover, the outer frame 131 is arranged around the suspension plate 130, and a conducting pin 134 is protruding outwardly from the outer frame 131 so as to be electrically connected with an external circuit (not shown).

In this embodiment, the suspension plate 130 has a bulge 130*c* that makes the suspension plate 130 a stepped structure. The bulge 130*c* is formed on a second surface 130*a* of the suspension plate 130, wherein the second surface 130*a* is opposing to the first surface 130*b*. The bulge 130*c* may be a circular convex structure. As shown in FIGS. 3A and 3C, a top surface of the bulge 130*c* of the suspension plate 130 is coplanar with a second surface 131*a* of the outer frame 131, while the second surface 130*a* of the suspension plate 130 is coplanar with a second surface 132*a* of the bracket 132. Moreover, there is a drop of specified amount from the bulge 130*c* of the suspension plate 130 (or the second surface 131*a* of the outer frame 131) to the second surface 130*a* of the suspension plate 130 (or the second surface 132*a* of the bracket 132). As shown in FIGS. 3B and 3C, a first surface 130*b* of the suspension plate 130, a first surface 131*b* of the outer frame 131 and a first surface 132*b* of the bracket 132 are coplanar with each other. The length of a side of the piezoelectric ceramic plate 133 is equal to or less than the length of a side of the suspension plate 130. The piezoelectric ceramic plate 133 is attached on the first surface 130*b* of the suspension plate 130. The suspension plate 130 may be a square plate structure with two flat surfaces, but the type of the suspension plate 130 may be varied according to the practical requirements. In this embodiment, the suspension plate 130, the at least bracket 132 and the outer frame 131 are integrally formed and produced by using a metal plate (e.g., a stainless steel plate, but the invention is not limited thereto).

The miniature fluid control device 1A further comprises the first insulation plate 141, the conducting plate 15 and the second insulation plate 142. The first insulation plate 141, the conducting plate 15 and the second insulation plate 142 are stacked on each other sequentially and located under the piezoelectric actuator 13. The profiles of the first insulation plate 141, the conducting plate 15 and the second insulation plate 142 substantially match the profile of the outer frame 131 of the piezoelectric actuator 13. The first insulation plate 141 and the second insulation plate 142 are made of an insulating material (e.g. a plastic material, but the invention is not limited thereto) for providing insulating efficacy. The conducting plate 15 is made of an electrically conductive material (e.g. a metallic material, but the invention is not limited thereto) for providing electrically conducting efficacy. Moreover, the conducting plate 15 has a conducting pin 151 so as to be electrically connected with an external circuit (not shown).

Figure 5A:
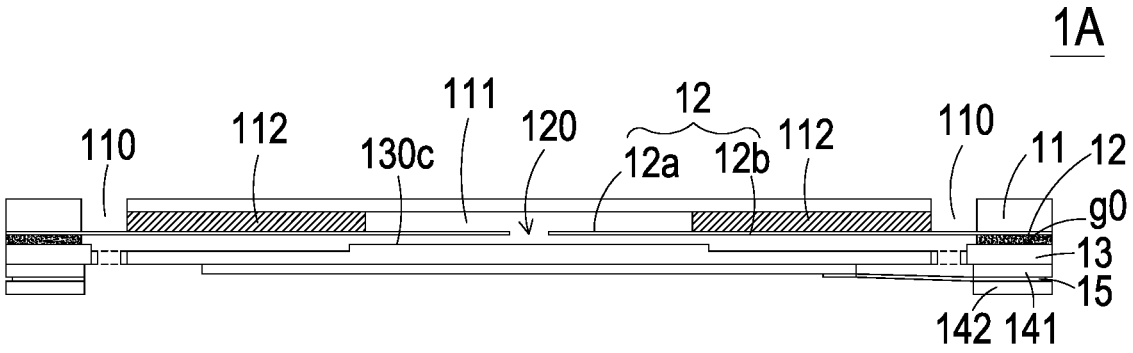
FIGS. 5A to 5E schematically illustrate the actions of the miniature fluid control device of the miniature pneumatic device according to the embodiment of the present invention.

As shown in FIG. 5A, the gas inlet plate 11, the resonance plate 12, the piezoelectric actuator 13, the first insulation plate 141, the conducting plate 15 and the second insulation plate 142 of the miniature fluid control device 1A are stacked on each other sequentially. Moreover, there is a gap g0 between the resonance plate 12 and the outer frame 131 of the piezoelectric actuator 13, which is formed and maintained by a filler (e.g. a conductive adhesive, but the invention is not limited thereto) inserted therein in this embodiment. The gap g0 ensures the proper distance between the resonance plate 12 and the bulge 130*c* of the suspension plate 130, so that the contact interference is reduced and the generated noise is largely reduced. In some other embodiments, the outer frame 131 is produced to be at a level higher than the piezoelectric actuator 13, so that the gap is formed between the resonance plate 12 and the piezoelectric actuator 13.

Please refer to FIGS. 5A to 5E again. After assembling the gas inlet plate 11, the resonance plate 12, and the piezoelectric actuator 13 sequentially, a convergence chamber for converging the gas is confined by the central aperture 120 of the resonance plate 12 and the gas inlet plate 11. And, a first chamber 121 for temporarily conserving the gas is formed between the resonance plate 12 and the piezoelectric actuator 13. The first chamber 121 is in communication with the convergence chamber of the central cavity 111 of the second surface 11*b* of the gas inlet plate 11 through the central aperture 120 of the resonance plate 12. Meanwhile, the peripheral regions of the first chamber 121 are in communication with the underlying miniature valve device 1B through the vacant space 135 of the piezoelectric actuator 13.

Figure 5B:
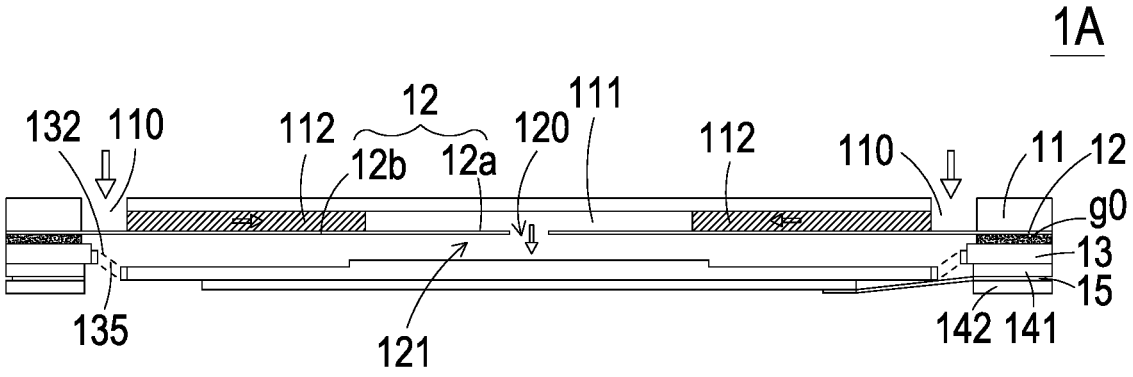

Please refer to FIG. 5B. When the miniature fluid control device 1A of the miniature pneumatic device 1 is enabled, the piezoelectric actuator 13 is actuated in response to an applied voltage. Consequently, the piezoelectric actuator 13 vibrates along a vertical direction in a reciprocating manner, while the brackets 132 are served as the fulcrums. Since the resonance plate 12 is light and thin, the resonance plate 12 vibrates along with the piezoelectric actuator 13 because of the resonance of the piezoelectric actuator 13. In other words, a movable part 12*a* of the resonance plate 12 is reciprocated and subjected to a curvy deformation, that is, the movable part 12*a* of the resonance plate 12 is aligned with the central cavity 111.

Figure 5C:
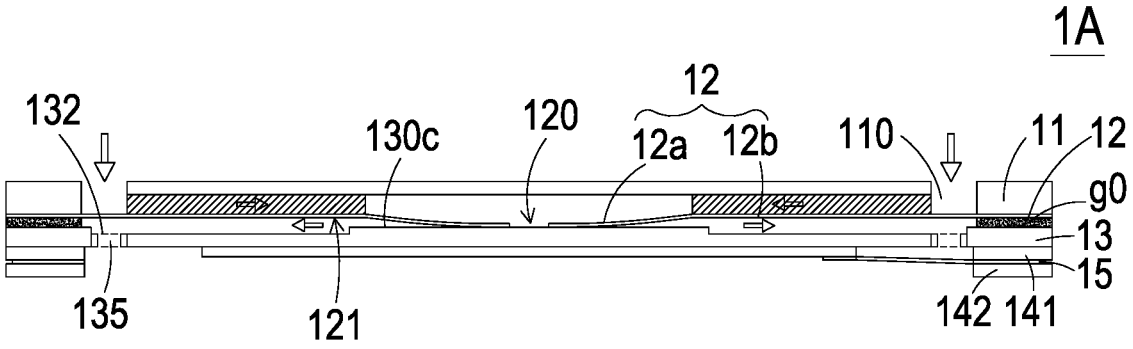

As shown in FIG. 5C, during the vibration of the movable part 12*a* of the resonance plate 12, the movable part 12*a* moves down till being contacted with the bulge 130*c* of the suspension plate 130. In the meantime, the volume of the first chamber 121 is shrunken and a middle space which was communicating with the convergence chamber is closed. As a result, the pressure gradient occurs to push the gas in the first chamber 121 moving toward peripheral regions of the first chamber 121 and flowing downwardly through the vacant spaces 135 of the piezoelectric actuator 13.

Figure 5D:
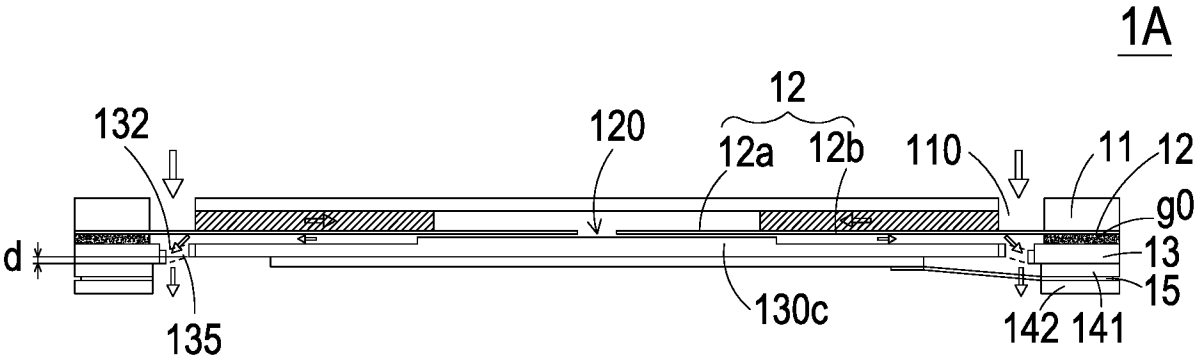

Please refer to FIG. 5D, which illustrates consecutive action following the action in FIG. 5C. The movable part 12*a* has returned its original position as the piezoelectric actuator 13 has ascended at a vibration displacement d to an upward position. Consequently, the volume of the first chamber 121 is consecutively shrunken that generating pressure gradient which makes the gas in the first chamber 121 continuously pushed toward peripheral regions and results in an exterior gas continuously fed into the inlets 110 of the gas inlet plate 11 and transferred to the central cavity 111.

Figure 5E:
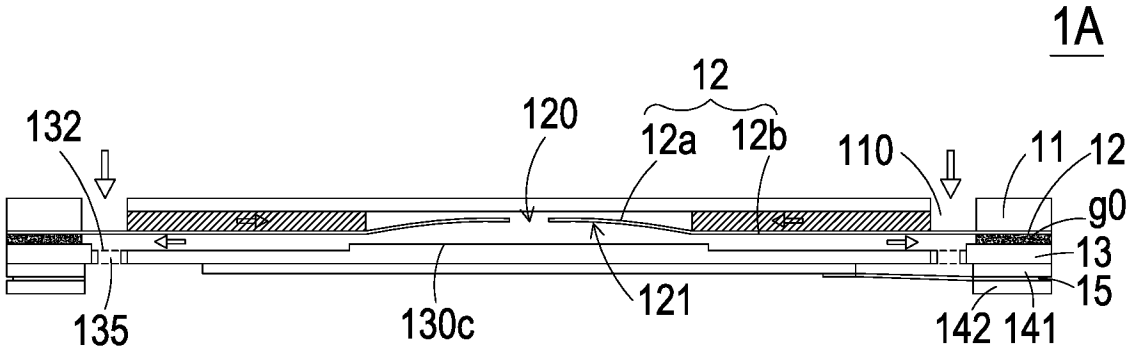

Then, as shown in FIG. 5E, the resonance plate 12 moves upwardly, which is caused by the resonance of the upward motion of the piezoelectric actuator 13.

Then, the movable part 12*a* of the resonance plate 12 is returned to the original position as shown in FIG. 5A. Under this circumstance, the volume of the first chamber 121 expends, which results in suction applied to the gas in the central cavity 111. The gas in the central cavity 111 is transferred to the first chamber 121 through the central aperture 120 of the resonance plate 12, then transferred downwardly through the vacant spaces 135 of the piezoelectric actuator 13, exiting from the miniature fluid control device 1A.

The valve film 17 and the gas outlet plate 18 of the miniature valve device 1B are stacked on each other sequentially. Moreover, the miniature valve device 1B cooperates with the gas collecting plate 16 of the miniature fluid control device 1A.

Please refer to FIGS. 1C, 2A and 2B again. The gas collecting plate 16 comprises a concave plane 160, a datum plane 161, a gas-collecting chamber 162, a first perforation 163, a second perforation 164, a first pressure-releasing chamber 165 and a first outlet chamber 166. The concave plane 160 is concaved to define the gas-collecting chamber 162. The datum plane 161 is concaved to form the first pressure-releasing chamber 165 and the first outlet chamber 166. The first pressure-releasing chamber 165 is in communication with the gas-collecting chamber 162 through the first perforation 163. The first outlet chamber 166 is in communication with the gas-collecting chamber 162 through the second perforation 164. The gas that is transferred downwardly by the miniature fluid control device 1A is temporarily accumulated in the gas-collecting chamber 162. Moreover, the first outlet chamber 166 further comprises a raised structure 167, and the raised structure 167 is located at a level higher than the datum plane 161 of the gas collecting plate 16. For example, the raised structure 167 includes but is not limited to a cylindrical post. And a plurality of tenons (e.g., six tenons, but the invention is not limited thereto) are formed on the datum plane 161 of the gas collecting plate 16.

The miniature fluid control device 1A and the miniature valve device 1B are combined together. That is, the valve film 17 and the gas outlet plate 18 of the miniature valve device 1B are stacked on each other sequentially and assembled with the gas collecting plate 16 of the miniature fluid control device 1A. The area of the gas outlet plate 18 is smaller than the area of the gas collecting plate 16. After the gas outlet plate 18 is assembled with the gas collecting plate 16, an adhesive-coating space is defined between the four edges of the gas outlet plate 18 and the gas collecting plate 16. A sealing adhesive 19 is filled in the adhesive-coating space between the gas outlet plate 18 and the gas collecting plate 16. Due to the increase of the adhesive-coating space, the area for coating the sealing adhesive 19 is increased. Consequently, the two ends of the valve film 17 between the miniature fluid control device 1A and the miniature valve device 1B are capped and sealing efficacy is increased. Consequently, the efficacy of avoiding gas leakage is enhanced.

The gas outlet plate 18 of the miniature valve device 1B comprises a pressure-releasing perforation 181, an outlet perforation 182, a datum plane 180 and a second surface 187. The datum plane 180 and the second surface 187 are opposed to each other. The pressure-releasing perforation 181 and the outlet perforation 182 are formed in the second surface 187 of the gas outlet plate 18. The pressure-releasing perforation 181 and the outlet perforation 182 penetrate through the datum plane 180 and the second surface 187. The datum plane 180 of the gas outlet plate 18 is concaved to define a second pressure-releasing chamber 183 and a second outlet chamber 184. The pressure-releasing perforation 181 is located at a center of the second pressure-releasing chamber 183, and the outlet perforation 182 is in communication with the second outlet chamber 184. Moreover, the gas outlet plate 18 further comprises a communication channel 185 between the second pressure-releasing chamber 183 and the second outlet chamber 184 for allowing the gas to go through. In this embodiment, the outlet perforation 182 is connected with a target equipment (not shown). The equipment is for example but not limited to a gas-pressure driving equipment. When the gas in the miniature valve device 1B releases from the pressure-releasing perforation 181, the pressure-releasing purpose is achieved.

After the miniature fluid control device 1A and the miniature valve device 1B are combined together, the miniature pneumatic device 1 is assembled. Consequently, a gas is fed into the miniature fluid control device 1A through at least one inlet 110 of the gas inlet plate 11. In response to the actions of the piezoelectric actuator 13, the gas is transferred downwardly through plural pressure chambers (not shown). Then, the gas is transferred through the miniature valve device 1B in one direction. The pressure of the gas is accumulated in the equipment (not shown) that is in communication with the outlet of the miniature valve device 1B. For releasing the pressure, the output gas amount of the miniature fluid control device 1A is adjusted, and the gas is exhausted from the pressure-releasing perforation 181 of the gas outlet plate 18 of the miniature valve device 1B.

In this embodiment, the gas outlet plate 18 has the convex structure 181*a* beside a first end of the pressure-releasing perforation 181. Preferably but not exclusively, the convex structure 181*a* is a cylindrical post. The height of the convex structure 181*a* may be increased according to the practical requirements. The top surface of the convex structure 181*a* is located at a level higher than the datum plane 180 of the gas outlet plate 18. Consequently, the pressure-releasing perforation 181 can be quickly contacted with and closed by the valve film 17. Moreover, the convex structure 181*a* can provide a pre-force against the valve film 17 to achieve a good sealing effect. In this embodiment, the gas outlet plate 18 further comprises a position-limiting structure 188. The position-limiting structure 188 is disposed within the second pressure-releasing chamber 183. Preferably but not exclusively, the position-limiting structure 188 is a ring-shaped structure. While the pressure-collecting operation of the miniature valve device 1B is performed, the position-limiting structure 188 can assist in supporting the valve film 17 and avoid collapse of the valve film 17. Consequently, the valve film 17 can be opened or closed more quickly.

Figure 4A:
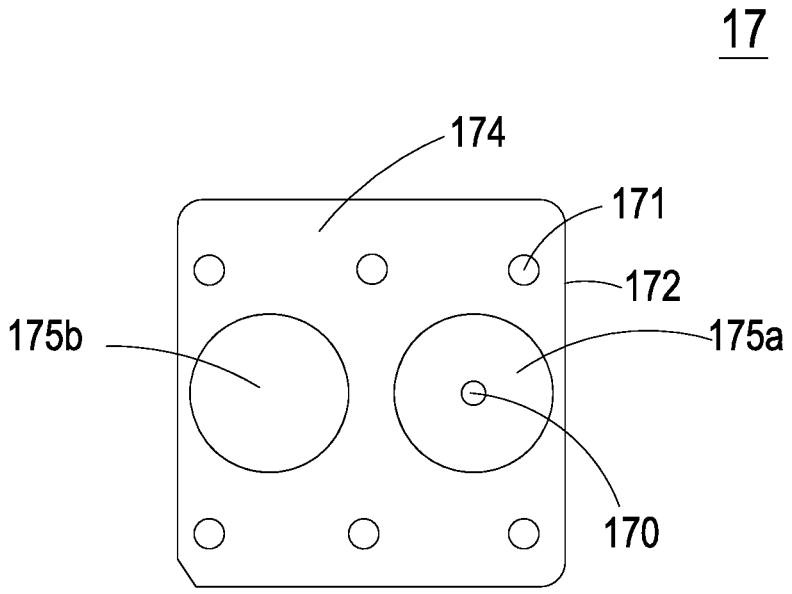
FIG. 4A is a schematic perspective view illustrating the valve film of the miniature pneumatic device of the present invention and taken along the front side.
Figure 4B:
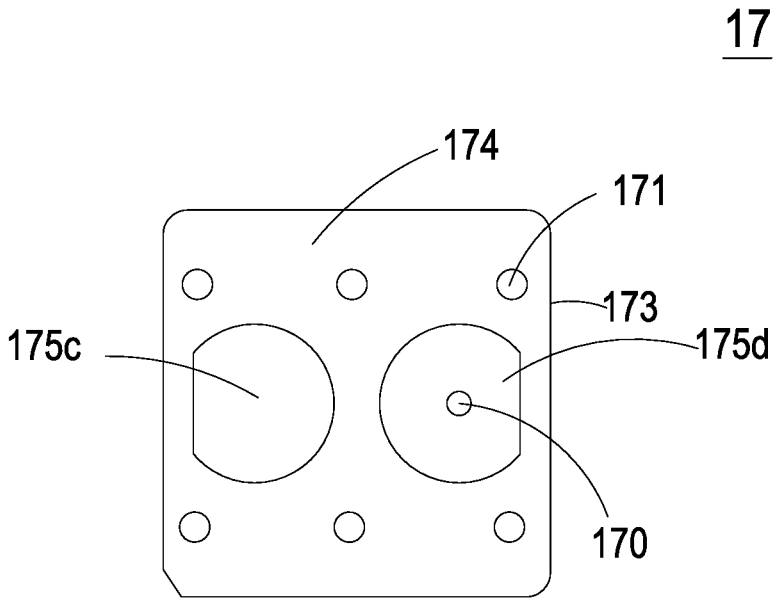
FIG. 4B is a schematic perspective view illustrating the valve film of the miniature pneumatic device of the present invention and taken along the rear side.

As shown in FIGS. 4A and 4B, the valve film 17 comprises a valve opening 170 and a plurality of positioning holes 171. The valve film 17 is arranged between the miniature fluid control device 1A and the miniature valve device 1B. The tenons 168 of the gas collecting plate 16 are penetrated through the corresponding positioning holes 171, and thus the valve film 17 is positioned on the gas collecting plate 16. For increasing the airtight efficacy of the valve film 17 between the miniature fluid control device 1A and the miniature valve device 1B, the valve film 17 is specially designed. Each of a first surface 172 and a second surface 173 of the valve film 17 comprises a sticking area 174 and a plurality of non-sticking areas. The non-sticking areas of the valve film 17 include a first non-sticking area 175*a*, a second non-sticking area 175*b*, a third non-sticking area 175*c*, and a fourth non-sticking area 175*d*. The first non-sticking area 175*a* and the second non-sticking area 175*b* are located on the first surface 172 of the valve film 17. The first non-sticking area 175*a* is aligned with the first outlet chamber 166 of the gas collecting plate 16. A profile of the first non-sticking area 175*a* matches a profile of the first outlet chamber 166. That is, an area of the first non-sticking area 175*a* is substantially equal to an area of the first outlet chamber 166. The second non-sticking area 175*b* is aligned with the first pressure-releasing chamber 165 of the gas collecting plate 16. A profile of the second non-sticking area 175*b* matches a profile of the first pressure-releasing chamber 165. Moreover, an area of the second non-sticking region 175*b* is substantially equal to an area of the first pressure-releasing chamber 165. The third non-sticking area 175*c* and the fourth non-sticking area 175*d* are located on the second surface 173 of the valve film 17. The third non-sticking area 175*c* is aligned with the second pressure-releasing chamber 183 of the gas outlet plate 18. A profile of the third non-sticking area 175*c* matches a profile of the second pressure-releasing chamber 183. Moreover, an area of the third non-sticking area 175*c* is substantially equal to an area of the second pressure-releasing chamber 183. The fourth non-sticking area 175*d* is aligned with the second outlet chamber 184 of the gas outlet plate 18. A profile of the fourth non-sticking area 175*d* matches a profile of the second outlet chamber 184. Moreover, an area of the fourth non-sticking area 175*d* is substantially equal to an area of the second outlet chamber 184. Moreover, a double-sided adhesive (not shown) is attached on the sticking area 174 of the first surface 172 of the valve film 17, and another double-sided adhesive (not shown) is attached on the sticking area 174 of the second surface 173 of the valve film 17. Consequently, the valve film 17 can be securely attached in the space between the miniature fluid control device 1A and the miniature valve device 1B. Since the double-sided tape is not attached on the first non-sticking area 175*a*, the second non-sticking area 175*b*, the third non-sticking area 175*c* and the fourth non-sticking area 175*d*, the open or close conditions of the first pressure-releasing chamber 165, the first outlet chamber 166, the second pressure-releasing chamber 183 and the second outlet chamber 184 are not influenced by the valve film 17. Since the valve film 17 can be closely attached on the datum plane 161 of the gas collecting plate 16 and the datum plane 180 of the gas outlet plate 18, the airtight efficacy is enhanced.

After the gas collecting plate 16, the valve film 17 and the gas outlet plate 18 are combined together, the pressure-releasing perforation 181 of the gas outlet plate 18 is aligned with the first perforation 163 of the gas collecting plate 16, the second pressure-releasing chamber 183 of the gas outlet plate 18 is aligned with the first pressure-releasing chamber 165 of the gas collecting plate 16, and the second outlet chamber 184 of the gas outlet plate 18 is aligned with the first outlet chamber 166 of the gas collecting plate 16. The valve film 17 is arranged between the gas collecting plate 16 and the gas outlet plate 18 for blocking the communication between the first pressure-releasing chamber 165 and the second pressure-releasing chamber 183. The valve opening 170 of the valve film 17 is arranged between the second perforation 164 and the outlet perforation 182. Moreover, the valve opening 170 of the valve film 17 is aligned with the raised structure 167 of the first outlet chamber 166 of the gas collecting plate 16. Due to such arrangement of the single valve opening 170, the gas can be transferred through the miniature valve device 1B in one direction in response to the pressure difference.

After the above components are combined together, the miniature pneumatic device 1 is assembled. A pressure-collecting operation of the miniature valve device 1B will be illustrated as follows. Firstly, the gas from the miniature fluid control device 1A is transferred to the gas-collecting chamber 162 of the miniature valve device 1B. Then, the gas is transferred downwardly to the first pressure-releasing chamber 165 and the first outlet chamber 166 through the first perforation 163 and the second perforation 164. In response to the downward gas, the flexible valve film 17 is subjected to a downward curvy deformation. Consequently, the volume of the first pressure-releasing chamber 165 is expanded, and the valve film 17 is in close contact with the first end of the pressure-releasing perforation 181 corresponding to the first perforation 163. Under this circumstance, the pressure-releasing perforation 181 of the gas outlet plate 18 is closed, and thus the gas within the second pressure-releasing chamber 183 is not leaked out from the pressure-releasing perforation 181. In this embodiment, the gas outlet plate 18 has the convex structure 181*a* beside the first end of the pressure-releasing perforation 181. Due to the arrangement of the convex structure 181*a*, the pressure-releasing perforation 181 can be quickly closed by the valve film 17. Moreover, the convex structure 181*a* can provide a pre-force to achieve a good sealing effect. The position-limiting structure 188 is arranged around the pressure-releasing perforation 181 to assist in supporting the valve film 17 and avoid collapse of the valve film 17. On the other hand, the gas is transferred downwardly to the first outlet chamber 166 through the second perforation 164. In response to the downward gas, the valve film 17 corresponding to the first outlet chamber 166 is also subjected to the downward curvy deformation. Consequently, the valve opening 170 of the valve film 17 is correspondingly opened to the downward side. Under this circumstance, the gas is transferred from the first outlet chamber 166 to the second outlet chamber 184 through the valve opening 170. Then, the gas is transferred to the target equipment (not shown) which is in communication with the outlet perforation 182 through the outlet perforation 182. Consequently, the purpose of collecting the gas pressure is achieved.

Figure 6A:
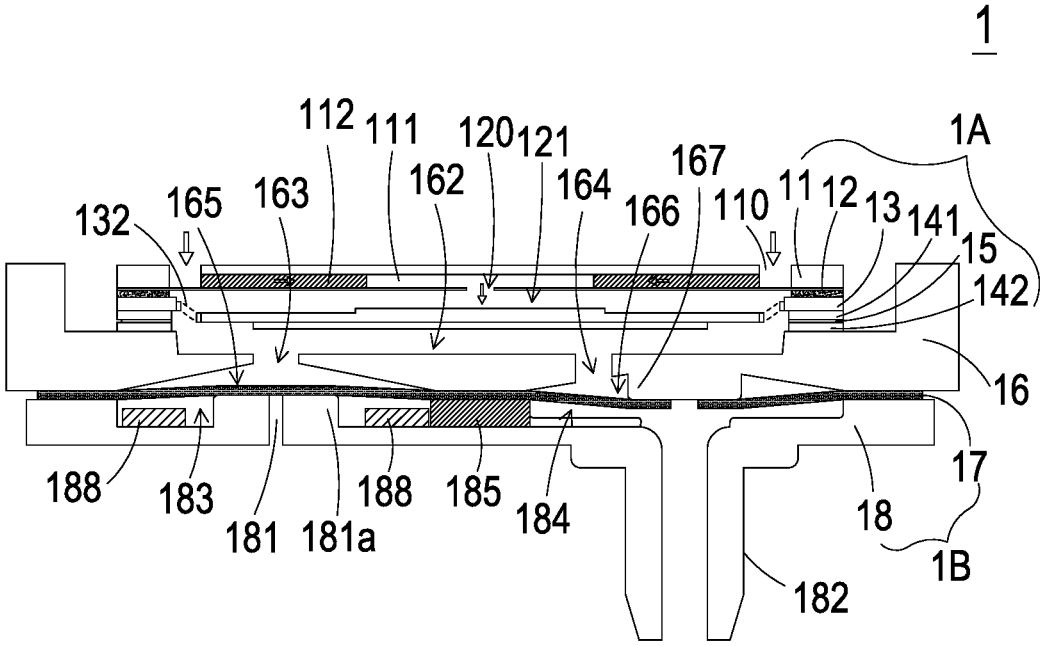
FIGS. 6A to 6D schematically illustrate a pressure-collecting operation of the miniature pneumatic device according to the embodiment of the present invention.

Please refer to FIG. 6A. The gas transferred downwardly from the miniature fluid control device 1A provides a pressure. The piezoelectric actuator 13 of the miniature fluid control device 1A is vibrated downwardly in response to the applied voltage. Consequently, the gas is fed into the miniature fluid control device 1A through the at least one inlet 110 of the gas inlet plate 11. The gas is sequentially converged to the central cavity 111 through the at least one convergence channel 112 of the gas inlet plate 11, transferred through the central aperture 120 of the resonance plate 12, and introduced downwardly into the first chamber 121.

Figure 6B:
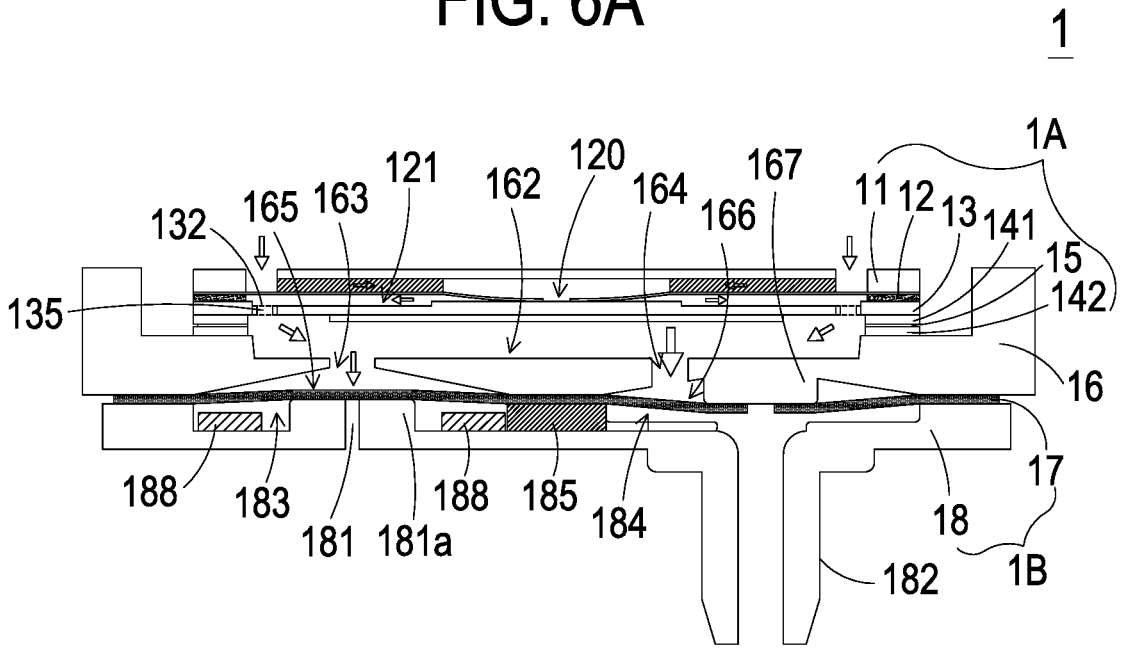

As the piezoelectric actuator 13 is actuated, the resonance of the resonance plate 12 occurs. Consequently, the resonance plate 12 is also vibrated along the vertical direction in the reciprocating manner. As shown in FIG. 6B, during the vibration of the movable part of the resonance plate 12, the movable part of the resonance plate 12 moves down till being contacted with the bulge 130*c* of the suspension plate 130. In the meantime, the volume of the chamber corresponding to the central cavity 111 of the gas inlet plate 11 is expanded but the volume of the first chamber 121 is shrunken. As a result, the gas is pushed toward peripheral regions of the first chamber 121 and flowing downwardly through the vacant spaces 135 of the piezoelectric actuator 13. Then, the gas is transferred to the gas-collecting chamber 162 between the miniature fluid control device 1A and the miniature valve device 1B. Then, the gas is transferred downwardly to the first pressure-releasing chamber 165 and the first outlet chamber 166 through the first perforation 163 and the second perforation 164, which are in communication with the gas-collecting chamber 162. Consequently, when the resonance plate 12 is vibrated along the vertical direction in the reciprocating manner, the gap g0 between the resonance plate 12 and the piezoelectric actuator 13 is helpful to increase the amplitude of the resonance plate 12. That is, due to the gap g0 between the resonance plate 12 and the piezoelectric actuator 13, the amplitude of the resonance plate 12 is increased when the resonance occurs.

Figure 6C:
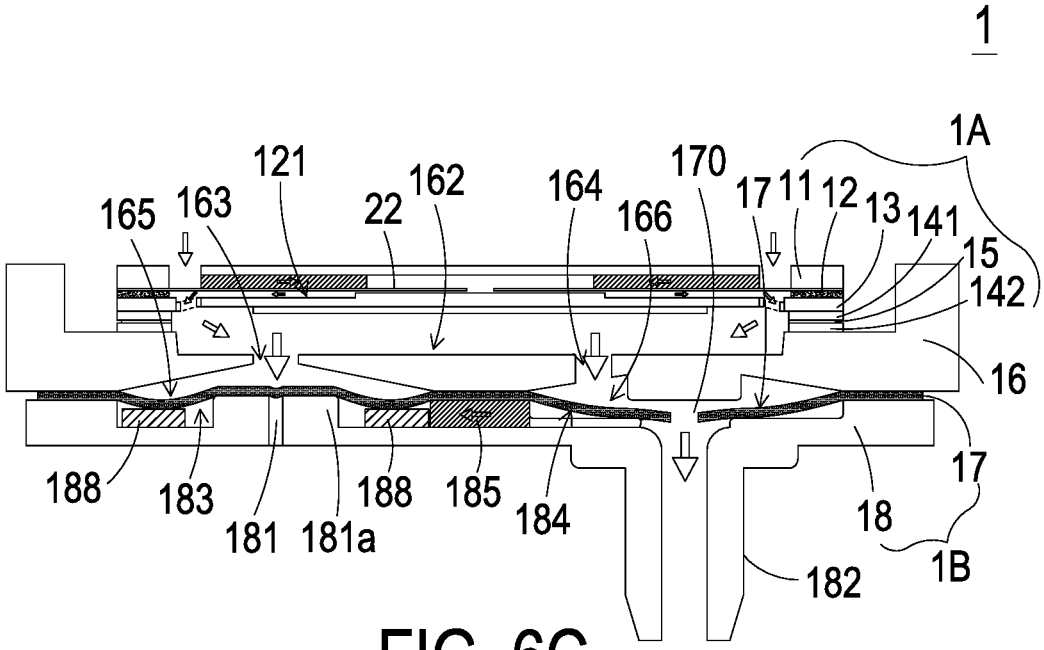

As shown in FIG. 6C, the movable part of the resonance plate 12 of the miniature fluid control device 1A has returned its original position as the piezoelectric actuator 13 has ascended at a vibration displacement to an upward position. Consequently, the volume of the first chamber 121 is consecutively shrunken, and the gas is continuously pushed toward peripheral regions of the first chamber 121. Moreover, the gas is continuously transferred to the gas-collecting chamber 162, the first pressure-releasing chamber 165 and the first outlet chamber 166 through the vacant space 135 of the piezoelectric actuator 13. Consequently, the pressure in the first pressure-releasing chamber 165 and the first outlet chamber 166 will be gradually increased. In response to the increased gas pressure, the flexible valve film 17 is subjected to the downward curvy deformation. Consequently, the valve film 17 corresponding to the second pressure-releasing chamber 183 is moved downwardly and contacted with the convex structure 181*a* of the first end of the pressure-releasing perforation 181. Under this circumstance, the pressure-releasing perforation 181 of the gas outlet plate 18 is closed. In the second outlet chamber 184, the valve opening 170 of the valve film 17 corresponding to the outlet perforation 182 is opened downwardly. Then, the gas within the second outlet chamber 184 is transferred downwardly through the outlet perforation 182 and then transferred to the equipment (not shown) which is in communication with the outlet perforation 182. Consequently, the purpose of collecting the gas pressure is achieved.

Figure 6D:
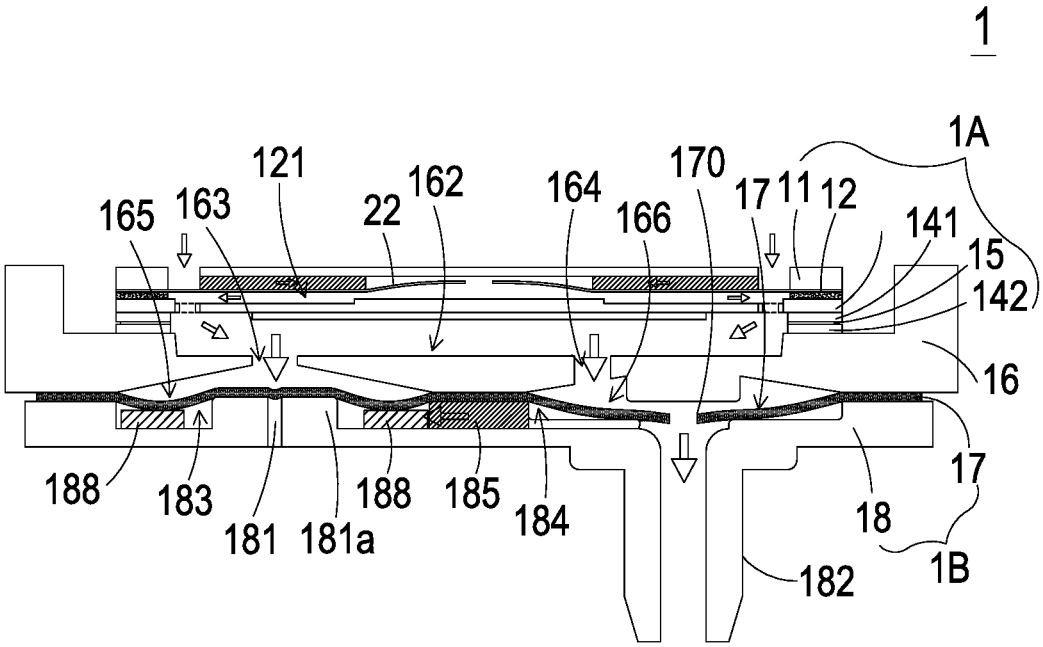
Figure 7:
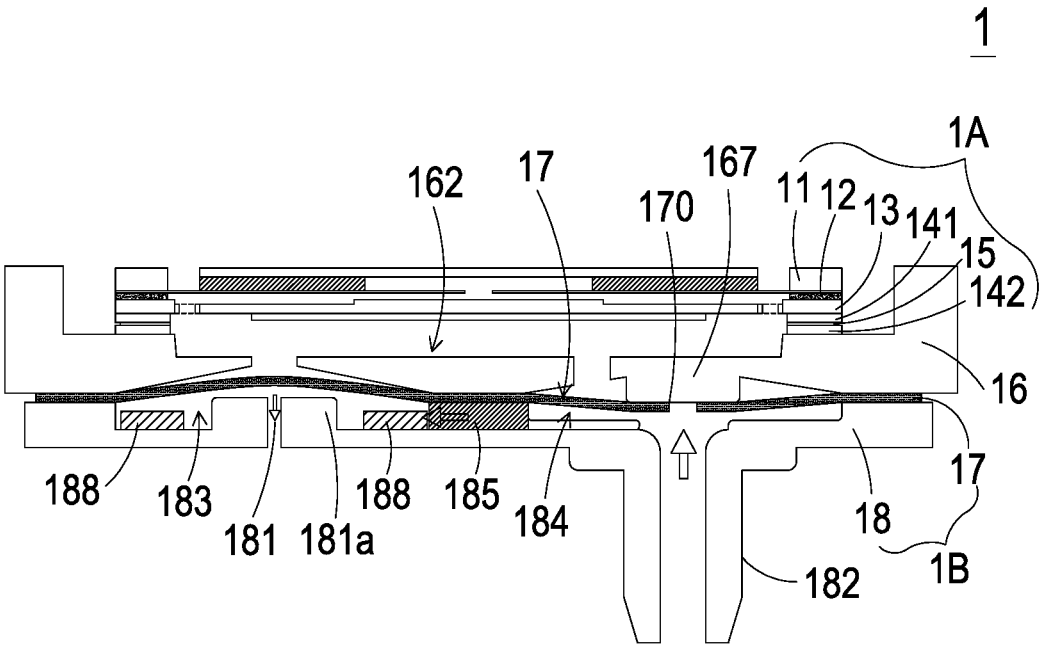
FIG. 7 schematically illustrates the pressure-releasing actions of the miniature pneumatic device according to the embodiment of present invention.
Figure 8:
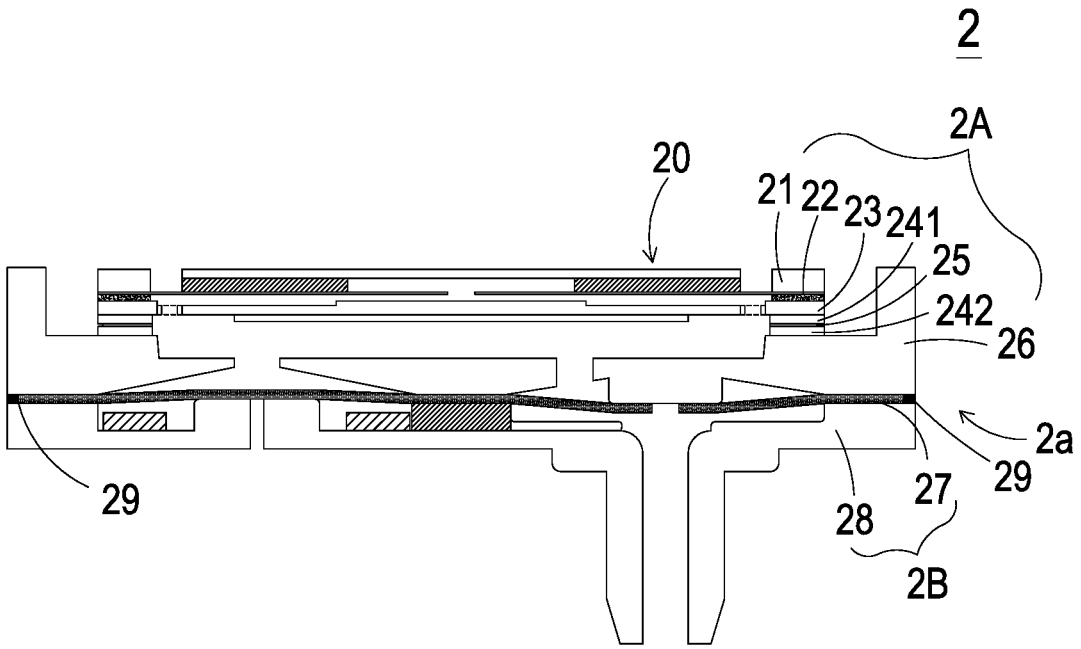
FIG. 8 (PRIOR ART)
FIG. 8 is a schematic cross-sectional view illustrating a conventional miniature pneumatic device.

Then, as shown in FIG. 6D, the resonance plate 12 of the miniature fluid control device 1A is vibrated upwardly. Under this circumstance, the gas in the central cavity 111 of the gas inlet plate 11 is transferred to the first chamber 121 through the central aperture 120 of the resonance plate 12, and then the gas is transferred downwardly to the miniature valve device 1B through the vacant space 135 of the piezoelectric actuator 13. As the gas pressure is continuously increased along the downward direction, the gas is continuously transferred to the gas-collecting chamber 162, the second perforation 164, the first outlet chamber 166, the second outlet chamber 184 and the outlet perforation 182 and then transferred to the equipment which is in communication with the outlet perforation 182. In other words, the pressure-collecting operation is triggered by the pressure difference between the ambient pressure and the inner pressure of the equipment, but the invention is not limited thereto.

As mentioned above, the user may adjust the amount of the gas to be fed into the miniature fluid control device 1A, so that the gas is no longer transferred to the gas-collecting chamber 162. Alternatively, in case that the inner pressure of the equipment (not shown) which is in communication with the outlet perforation 182 is higher than the ambient air pressure, the pressure-releasing operation of the miniature valve device 1B may be performed. Under this circumstance, the gas is transferred from the outlet perforation 182 to the second outlet chamber 184 through the outlet perforation 182. Consequently, the volume of the second outlet chamber 184 is expanded, and the flexible valve film 17 corresponding to the second outlet chamber 184 is bent upwardly. Since the valve film 17 is in close contact with the gas collecting plate 16, the valve opening 170 of the valve film 17 is closed. Moreover, the gas collecting plate 16 further comprises a raised structure 167 beside the first outlet chamber 166. Due to the raised structure 167, the valve film 17 can be quickly contacted with the gas collecting plate 16 when the flexible valve film 17 is subjected to the upward curvy deformation. Moreover, the raised structure 167 can provide a pre-force to achieve a good sealing effect. Consequently, the valve opening 170 of the valve film 17 can be quickly contacted with and closed by the raised structure 167. In the initial state, the valve opening 170 of the valve film 17 is closed by the raised structure 167. Meanwhile, the gas in the second outlet chamber 184 will not be reversely returned to the first outlet chamber 166. Consequently, the efficacy of avoiding gas leakage is enhanced. Moreover, the gas in the second outlet chamber 184 is transferred to the second pressure-releasing chamber 183 through the communication channel 185. Consequently, the volume of the second pressure-releasing chamber 183 is expanded, and the valve film 17 corresponding to the second pressure-releasing chamber 183 is subjected to the upward curvy deformation. Since the valve film 17 is no longer in contact with the first end of the pressure-releasing perforation 181, the pressure-releasing perforation 181 is opened. Under this circumstance, the gas in the second pressure-releasing chamber 183 is outputted through the pressure-releasing perforation 181. Consequently, the pressure of the gas is released. Similarly, due to the convex structure 181*a* beside the pressure-releasing perforation 181 or the position-limiting structure 188 within the second pressure-releasing chamber 183, the flexible valve film 17 can be subjected to the upward curvy deformation more quickly. Consequently, the pressure-releasing perforation 181 can be quickly opened. After the pressure-releasing operation in one direction is performed, the gas within the equipment (not shown) which is in communication with the outlet perforation 182 is partially or completely exhausted to the surrounding. Under this circumstance, the pressure-releasing operation is performed.

From the above descriptions, the present invention provides the miniature pneumatic device. The miniature pneumatic device comprises the miniature fluid control device and the miniature valve device. After the gas is fed into the miniature fluid control device through the inlet, the piezoelectric actuator is actuated. Consequently, a pressure gradient is generated in the fluid channels of the miniature fluid control device and the gas-collecting chamber to facilitate the gas to flow to the miniature valve device at a high speed. Moreover, due to the one-way valve film of the miniature valve device, the gas is transferred in one direction. Consequently, the pressure of the gas is accumulated to any equipment that is connected with the outlet perforation. Moreover, since the area of the gas outlet plate of the miniature valve device is smaller than the area of the gas collecting plate of the miniature fluid control device, an adhesive-coating space is defined between the periphery region of the gas outlet plate and the gas collecting plate.

Due to the adhesive-coating space, the sealing efficacy is increased. Moreover, since the double-sided adhesives are attached on the sticking areas of the first surface and the second surface of the valve film, the valve film can be securely attached in the space between the miniature fluid control device and the miniature valve device. Consequently, the airtight efficacy is enhanced. By the miniature pneumatic device of the present invention, the gas can be quickly transferred while achieving silent efficacy. Moreover, due to the special configurations, the miniature pneumatic device of the present invention has small volume and small thickness. Consequently, the miniature pneumatic device is portable and applied to medical equipment or any other appropriate equipment. In other words, the miniature pneumatic device of the present invention has industrial values.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A miniature pneumatic device, comprising:

a miniature fluid control device comprising:

a gas inlet plate;

a resonance plate having a central aperture;

a piezoelectric actuator;

a gas collecting plate comprising a concave plane, a datum plane, a first perforation and a second perforation, wherein the concave plane is concaved to form a gas-collecting chamber, the datum plane is concaved to form a first pressure-releasing chamber and a first outlet chamber, the first pressure-releasing chamber is in communication with the gas-collecting chamber through the first perforation, and the first outlet chamber is in communication with the gas-collecting chamber through the second perforation, wherein the gas inlet plate, the resonance plate, the piezoelectric actuator and the gas collecting plate are stacked on each other sequentially, and a gap is formed between the resonance plate and the piezoelectric actuator to define a first chamber, wherein when the piezoelectric actuator is actuated, the gas is fed into the miniature fluid control device through the gas inlet plate, transferred through the resonance plate, and introduced into the first chamber; and a miniature valve device positioned on the gas collecting plate of the miniature fluid control device, wherein the miniature valve device comprises:

a valve film comprising a first surface, a second surface and a valve opening, wherein the valve opening penetrates through the first surface and the second surface, and each of the first surface and the second surface comprises a sticking area and a plurality of non-sticking areas; and a gas outlet plate comprising a datum plane and a second surface, wherein a pressure-releasing perforation and an outlet perforation are respectively formed on the second surface of the gas outlet plate and penetrate through the datum plane of the gas outlet plate, the datum plane of the gas outlet plate is concaved to form a second pressure-releasing chamber and a second outlet chamber, the pressure-releasing perforation is located at a center of the second pressure-releasing chamber, the outlet perforation is in communication with the second outlet chamber, and the gas outlet plate further comprises a communication channel between the second pressure-releasing chamber and the second outlet chamber, wherein the valve film and the gas outlet plate are sequentially stacked on the gas collecting plate, an area of the gas outlet plate is smaller than an area of the gas collecting plate in order to shrink four edges of the gas outlet plate to maintain an adhesive-coating space formed between four edges of the gas outlet plate and the gas collecting plate, a sealing adhesive is filled in the adhesive-coating space to completely seal a periphery region of the valve film, and the valve film is positioned between the gas outlet plate and the gas collecting plate through the sticking areas of the first surface and the second surface, wherein a gas is transferred from the miniature fluid control device to the miniature valve device, so that a pressure-collecting operation or a pressure-releasing operation is selectively performed.

2. The miniature pneumatic device according to claim 1, wherein the sticking areas of the first surface and the second surface of the valve film are respectively attached on the gas outlet plate and the gas collecting plate via double-sided adhesives.

3. The miniature pneumatic device according to claim 1, wherein a plurality of non-sticking areas of the valve film are a first non-sticking area and a second non-sticking area respectively located on the first surface of the valve film, the first non-sticking area is aligned with the first outlet chamber of the gas collecting plate, a profile of the first non-sticking area matches a profile of the first outlet chamber, an area of the first non-sticking area is substantially equal to an area of the first outlet chamber, the second non-sticking area is aligned with the first pressure-releasing chamber of the gas collecting plate, a profile of the second non-sticking area matches a profile of the first pressure-releasing chamber, and an area of the second non-sticking area is substantially equal to an area of the first pressure-releasing chamber.

4. The miniature pneumatic device according to claim 1, wherein a plurality of non-sticking areas of the valve film are a third non-sticking area and a fourth non-sticking area respectively located on the second surface of the valve film, the third non-sticking area is aligned with the second pressure-releasing chamber of the gas outlet plate, a profile of the third non-sticking area matches a profile of the second pressure-releasing chamber, an area of the third non-sticking area is substantially equal to an area of the second pressure-releasing chamber, the fourth non-sticking area is aligned with the second outlet chamber of the gas outlet plate, a profile of the fourth non-sticking area matches a profile of the second outlet chamber, and an area of the fourth non-sticking area is substantially equal to an area of the second outlet chamber.

5. The miniature pneumatic device according to claim 1, wherein the gas inlet plate comprises at least one inlet for introducing the gas, at least one convergence channel aligned with the inlet, and a central cavity constructing a convergence chamber, the gas of the inlet is guided by the at least one convergence channel and converged to the convergence chamber, and the convergence chamber is aligned with the central aperture of the resonance plate.

6. The miniature pneumatic device according to claim 1, wherein the piezoelectric actuator comprises:

a suspension plate, wherein the suspension plate is permitted to undergo a curvy vibration from a middle portion to a periphery portion of the suspension plate;

an outer frame arranged around the suspension plate;

at least one bracket connected between the suspension plate and the outer frame for elastically supporting the suspension plate; and a piezoelectric ceramic plate, wherein a length of the piezoelectric ceramic plate is equal to or less than a length of the suspension plate, and the piezoelectric ceramic plate is attached on a first surface of the suspension plate, a voltage is applied to the piezoelectric ceramic plate to drive the suspension plate to undergo the curvy vibration.

7. The miniature pneumatic device according to claim 6, wherein the suspension plate has a square shape.

8. The miniature pneumatic device according to claim 1, wherein the first outlet chamber further comprises a raised structure, and the raised structure is located at a level higher than the datum plane of the gas collecting plate.

9. The miniature pneumatic device according to claim 1, wherein a convex structure is located beside an end of the pressure-releasing perforation, and the convex structure is located at a level higher than the datum plane of the gas outlet plate.

10. The miniature pneumatic device according to claim 1, wherein the gas outlet plate further comprises at least one position-limiting structure, wherein the at least one position-limiting structure is disposed within the second pressure-releasing chamber, and the at least one position-limiting structure assist in supporting the valve film so as to avoid collapse of the valve film.

* * * * *